United States Patent [19]

Hall et al.

[11] 3,972,793

[45] Aug. 3, 1976

[54] CONTINUOUS FLOW-THROUGH MERCURY CATHODE ELECTROLYSIS CELL

[75] Inventors: David A. Hall, Indianapolis; Donnis M. Berry, Greenwood; Paul W. Landis, Indianapolis, all of Ind.

[73] Assignee: Eli Lilly and Company, Indianapolis, Ind.

[22] Filed: Sept. 26, 1975

[21] Appl. No.: 616,988

[52] U.S. Cl. ..... 204/219; 204/251; 204/275

[51] Int. Cl.[2] ..... C21D 21/10

[58] Field of Search ..... 204/219, 251, 263, 275

[56] References Cited

UNITED STATES PATENTS

| | | | |
|---|---|---|---|
| 2,688,594 | 9/1954 | Oosterman | 204/219 |
| 3,657,099 | 4/1972 | Seko et al. | 204/263 |
| 3,728,235 | 4/1973 | Cooley et al. | 204/275 |
| 3,728,244 | 4/1973 | Cooley et al. | 204/275 |
| 3,846,270 | 11/1974 | Muto et al. | 204/263 |
| 3,917,524 | 11/1975 | Connery et al. | 204/275 |

*Primary Examiner*—T. M. Tufariello
*Attorney, Agent, or Firm*—Ralph W. Ernsberger; Everet F. Smith

[57] ABSTRACT

A continuous flow-through mercury cathode electrolysis cell is described having a parallel anode and cathode and a non-conductive porous diaphragm separator. The cathode chamber is constructed so as to develop turbulence in the catholyte flowing therethrough to effect the maximum contact between the mercury and the catholyte solute and to promote removal therefrom of any gaseous by-products. Built-in heat exchangers provide efficient control of temperature sensitive electrolyses.

6 Claims, 4 Drawing Figures

CONTINUOUS FLOW-THROUGH MERCURY CATHODE ELECTROLYSIS CELL

BACKGROUND OF THE INVENTION

1. Field of Invention

This invention concerns a mercury cathode electrolysis cell. More particularly this invention relates to a continuous flow-through mercury cathode electrolysis cell having parallel anolyte and catholyte chambers wherein the continuously flowing anolyte and catholyte are separated by a non-conductive porous diaphragm. The catholyte chamber is constructed to induce turbulence in the catholyte as it flows therethrough. Means are provided internally for removing heat from the electrolytes.

2. Prior Art

Electrolysis cells are very old in the art. Mercury cathode electrolysis cells have been in use for a long time. Until very recently, however, the principal industrial use for electrolysis cells was in the production of chlorine and caustic soda. Electrochemical synthesis has been used for producing only a comparatively few organic substances. Because many organic syntheses take place at low current densities and temperatures, difficult engineering problems have been encountered in the construction of electrolyzers for use in the electrolysis of such reactions. The requirement for low current densities has meant that efficiency of operation could be achieved only by making the electrode area as large as possible in relation to the volume of the cathode compartment. Consequently, while laboratory electrolyzers were constructed which accomplished the desired electrolysis, the scale-up of such designs to economically feasible large scale operations has been difficult, if not totally impractical.

Goodridge [Goodridge, F., Design of Continuous Electrolytic Cells, *Chemical and Process Engineering*, 49, 2, 93–95 and 100. (1968) (London)] reviewed the construction of a number of electrolyzers which were felt to be susceptible of a scale-up to economic production use. While Goodridge's review was not intended to be inclusive it is noteworthy that mercury cathode cells were not included.

Tomilov, et al. [Tomilov, A. P. and Fioshim M. Ya., Industrial Electrolyzers for Organic Syntheses, *British Chemical Engineering*, 16, 2–3, 154–59, (1971) (London)] included a continuous flow mercury cathode electrolyzer in their review. This cell was described by Wasilewski, et al., in 1964 [Wasilewski L., Korzynski A., Prszczek L., and Kurzeja J., *Zesz. Nauk. Politechn. Slaskiej*, - 108, 35–52, (1964) (Warsaw)]. The Wasilewski, et al., design provides a continuously renewable mercury cathode by overflowing mercury from upper shelves onto lower shelves. The anode is disposed in a vertical attitude. The temperature can be controlled in both the anode and cathode chambers. Means are provided for returning the mercury from the bottom to the upper shelf. It was claimed that such a design permitted an enlargement in the cathode surface and increase in the electrolyzer capacity by the stacking of the shelves holding the mercury cathode, thereby reducing the overall dimension of the cell in relation to the total cathode area. The Wasilewski, et al., cell suffers from at least two serious deficiencies. First, means must be provided to transfer the overflow of mercury from the bottom back up to the top shelf; or, alternatively, a reservoir of mercury must be maintained to supply the uppermost shelf throughout the electrolysis operation. And, second, because of the right angle relationship of the mercury cathode to the anode there is an unequal distance between the surfaces which produces an uneven distribution of the potential across the cathode which reduces the efficiency of the operation.

Accordingly, it is an object of this invention to provide a continuous flow-through mercury cathode electrolytic cell with a relatively high ratio of cathode electrode area to chamber volume, essentially of the order of 1.4 $cm^{-1}$, or greater.

Another object of this invention is to provide a mercury cathode electrolytic cell wherein the anode and cathode are substantially parallel and the flow of the anolyte and catholyte through the respective chambers is essentially parallel.

Still another object of this invention is to direct the flow of the catholyte into and out of the cathode chamber in a pattern that maximizes the contact between the molecules of solute in the catholyte and the mercury cathode without entraining mercury in the effluent catholyte.

Yet another object of this invention is to provide substantial turbulence in the catholyte flowing in the catholyte chamber to continuously scour the surface of the mercury cathode resulting in a continual renewal of such surface.

Still another object of this invention is to provide a self-aspirating effect at the exit from the cathode chamber for the easy removal of any gaseous by-products which may be formed by the electrolysis.

SUMMARY

It has now been discovered that a continuous flow-through mercury cathode electrolysis cell having a relatively high cathode electrode area to volume ratio, parallel anode and cathode, efficient stirring of the catholyte in the cathode chamber, good temperature control and a self-aspirating catholyte exit which rids the cathode chamber of generated gases can be comprised of: (1) An anolyte chamber comprising a wide shallow cavity closed on the top with an inlet and outlet on opposite sides thereof and means therein to remove the heat of electrolysis. (2) A catholyte chamber comprising a wide shallow cavity closed on the bottom with an inlet entering on the side of such cavity at an acute angle and an outlet therefrom consisting of a standpipe located essentially in the center of such cavity and extending upwardly therein to a point just below a cross-sectional projection of the open edge of such cavity and means therein to remove the heat of electrolysis. (3) A non-conductive porous plate which serves as the bottom of the anolyte chamber and the top of the catholyte chamber. (4) Means for axially disposing said anolyte and catholyte chambers in a vertical attitude in a fluid tight assembly, the anolyte above the catholyte with said porous plate separating the two chambers. And, (5) a mercury pool disposed in the bottom of said catholyte chamber.

DESCRIPTION OF THE PREFERRED EMBODIMENTS

In the following detailed description of the embodiments of this invention, reference is made to the accompanying drawing.

In the instant invention a continuous flow-through mercury cathode electrolysis cell is comprised of:

1. A first chamber comprising a wide shallow cavity closed on the top and open on the bottom, said cavity having an inlet port and an oppositely disposed outlet port.
2. A non-conductive porous plate adapted to be the bottom of said first chamber and the top of a second chamber.
3. A second chamber comprising a wide shallow cavity closed on the bottom and open on the top, said cavity having one or more inlet ports opening thereinto near the top thereof, at an acute angle to the side thereof, and an outlet port therefrom comprising a standpipe extending upwardly from the bottom of said cavity to a point just below the top thereof and substantially in the center thereof.
4. Means for axially disposing said first and second chambers in a vertical orientation in a fluid tight assembly, the first above the second with said porous plate separating the two chambers and,
5. A mercury pool disposed in the bottom of said second chamber.

Alternatively, means can be provided in each of the first and second chambers for the removal of the heat of electrolysis.

Inasmuch as the two chambers are separated by a non-conductive porous plate, said chambers can be of conductive materials and serve as the electrode for conducting current to an anolyte flowing in the upper chamber and the electrical contact to the mercury cathode used in the lower chamber to electrolyze the solute in the catholyte flowing therein.

Preferably, both chambers can be of non-conductive material with an electrode disposed therein through which current is conducted to the anolyte and catholyte respectively, the latter through the mercury pool cathode. A preferred electrode means for both chambers is comprised of conductive heat exchange means which are disposed in each chamber to remove the heat of electrolysis. One illustration of an effective combination heat exchange means and an electrode means comprises conductive tubes, disposed laterally in each chamber, through which a cooling medium can be passed and which in turn can be connected to the respective terminals of an electric power source.

The useful flow-through mercury cathode electrolysis cell of the instant invention is constructed and operated as described hereinafter.

Figure 1:
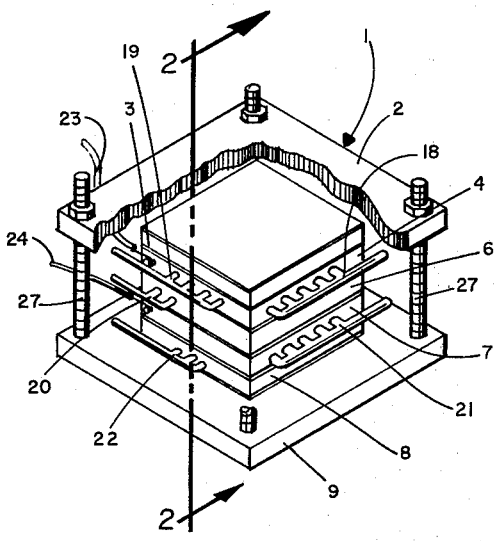
FIG. 1 is a partially cut-away perspective view of a continuous flow-through mercury cathode electrolysis cell.

In FIG. 1, a partially cut-away perspective view is shown of an assembled continuous flow-through mercury cathode electrolysis cell 1. In this rendering the first chamber of said cell is shown as the combined chamber top 3 and the section of the chamber which constitutes the wide shallow cavity 4. The second chamber is shown as a combination of sections 6, the uppermost part of the cavity; 7, the section of the cavity in which the mercury pool is disposed; and 8, the bottom of the cavity from which the outlet port standpipe extends upwardly. The non-conductive porous plate is not exposed in this rendering. The first and second chambers are assembled in a vertical orientation and held together by plates 2 and 9 which are drawn together and fastened into a fluid tight assembly by four corner studs 27 anchored into plate 9 and threaded to accept nuts used to pull plate 2 tight against the assembly. Sections 3 and 8 are non-conductive material such as Teflon.

Manifold 19 connects with inlet ports (not shown here, but as 12 in FIG. 4) to the first chamber. Manifold 18 connects with lateral cooling tubes (not shown here, but as 11 in FIG. 4) traversing said first chamber.

Manifold 20 connects with inlet ports 13 (not shown here) to the second chamber. Another manifold 22 connects with outlet ports 28 (not shown here). Still another manifold 21 connects with conductive cooling tubes 16 (not shown here) which are covered by the mercury pool. The anode terminal 23 is fastened to section 4 of the first chamber and connects internally to the conductive tubes in such section. The cathode terminal 24 is fastened to section 7 of the second chamber and is connected internally to conductive tubes in such section.

Figure 2:
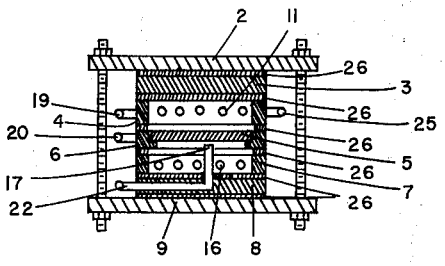
FIG. 2 is a cross-sectional view of a continuous flow-through mercury cathode electrolysis cell.
Figure 3:
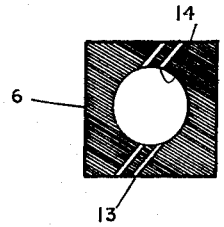
FIG. 3 is a cross-sectional plan view of the inlets to the catholyte chamber of the continuous flow-through mercury cathode electrolysis cell.

The internal construction of the continuous flow-through mercury cathode electrolysis cell is shown in FIG. 2 of the accompanying drawing. Sections 3 and 4 comprise the first chamber. Section 4 is insulated from section 6, which holds the non-conductive porous plate 5, which in turn is insulated from its support, by a high dielectric, fluid tight insulator. The lower portion of section 6 and section 7 comprise the cavity of the second chamber; section 8 comprising the bottom of such chamber. The inlet manifold 20 allows the catholyte to enter the second chamber. The inlet ports 13 connect with said manifold 20 in section 6 of the electrolysis cell. The acute angle entry which is critical in the construction and operation of the useful electrolysis cell of the invention is shown in FIG. 3. The inlet 13 into the second chamber is shown entering said chamber at an acute angle 14.

Cooling tubes 11 and 16 are shown in sections 4 and 7. These tubes also serve as electrodes conducting the current respectively to an anolyte circulating in the first chamber and to a mercury pool which completely covers tubes 16 in section 7 and extends to the top thereof. The outlet from the second chamber is shown as standpipe 17 which connects with discharge manifold 22.

Figure 4:
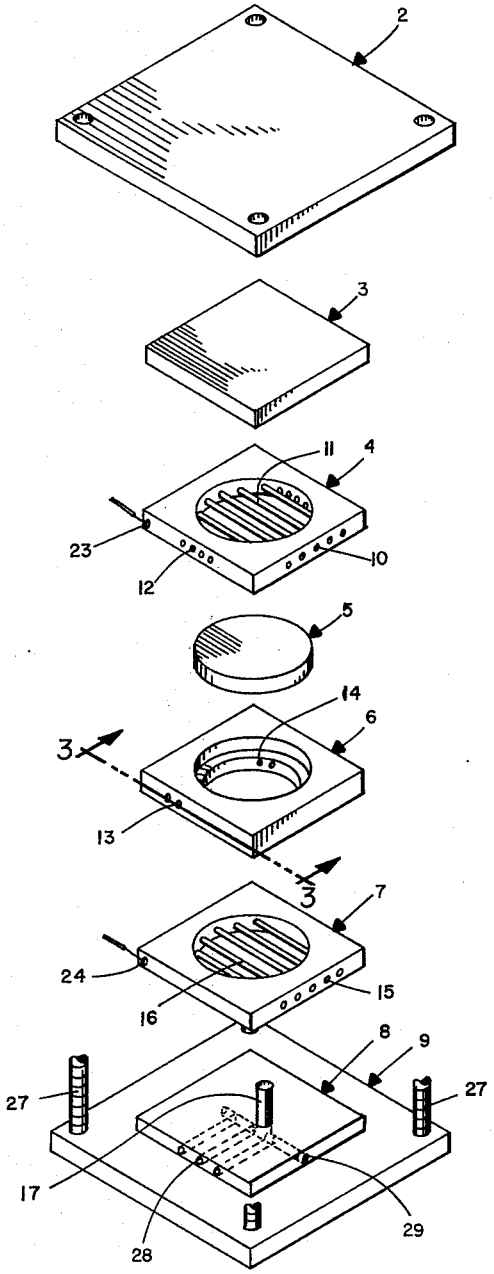
FIG. 4 is an expanded perspective view of the continuous flow-through mercury cathode electrolysis cell showing each of the component parts of one embodiment of such cell.

A more detailed scheme of the assembly of the parts comprising one exemplification of the novel electrolysis cell of this invention is shown in the exploded perspective of FIG. 4.

Top assembly plate 2 is the uppermost member shown. Members 3 and 4 comprise the first chamber of the cell. Simplification of construction and illustration resulted in the two piece construction for the first chamber. Such first chamber could just as well be of one piece construction. No insulating gaskets are shown in FIG. 4 as they are illustrated in other FIGS. and will be well known to those skilled in the art. The inlet ports 12 to the first chamber are shown as four in number. Such number is not a part of this invention. The combination cooling tubes/electrode 11 and the inlet ports 10 thereto are shown as five in number, which is for convenience only and the number thereof constitutes no part of the invention. The anode terminal 23 connects internally with the cooling tubes-electrode.

The non-conductive porous diaphragm 5 is shown apart from its support section 6. Such diaphragm could just as well have the same external dimensions as the sections forming the first and second chambers. However, because the material of choice for the diaphragm is unglazed porcelain, an impact brittle material, it is preferred to support such diaphragm with the independent section 6. Of critical importance to the invention is the opening of the inlet ports 13 into the catholyte cavity. The inlet ports 13 are so disposed as to introduce the flow of fluid into the second chamber at an acute angle 14 to the side of such chamber. An entrance substantially parallel to a tangent to the cavity at the point of entrance would be ideal. Such an entrance terminating at the end of a substantial length of a straight cylinder introduces the fluid into a circular pattern in the second chamber and assures maximum turbulence of the fluid in such chamber. The recessed space into which the non-conductive porous diaphragm is disposed can be seen in FIG. 4. Preferably section 6 is constructed of a non-conductive material and the gaskets which seal the diaphragm in the section and the section from sections 4 and 7 and are of a high dielectric insulating material.

As shown in FIG. 4 the bottom part of section 6, and sections 7 and 8 comprise the second chamber of the electrolysis cell. Section 7 is shown with five combination cooling tubes-electrodes 16 and inlets 15 thereto, but the number thereof constitutes no part of this invention. The cathode terminal 24 is connected internally to the cooling tubes-electrodes 16. The bottom 8 of the second chamber is shown disposed on the bottom assembly plate 9. The standpipe 17 which is the outlet from the second chamber is shown disposed substantially in the center of section 8. Such standpipe 17 rises higher than the top of section 7, shown more clearly in FIG. 2, to a point which, when the cell is assembled, brings the top of such standpipe just below the bottom of the non-conductive porous diaphragm 5. The internal channeling of the flow from standpipe 17 is shown with the outlet therefrom depicted at 28. The lateral drive which connects with the bottom of the standpipe 17 and the outlet ports 28 is shown at 29.

As with the first chamber, the second chamber could just as well be of one piece construction. If the non-conductive porous plate 5 were not disposed in a support such as is shown, but were to have the same internal dimension as the first and second chambers, and such chambers were of one piece construction of non-conductive material, high dielectric insulators would only be required between such porous plate 5 and each of the two chambers. A provision would be required to prevent leakage from the exposed edge of such a porous plate.

Alternatively, with either multi-member or one piece construction, means could be provided on each of the two chambers to bring them together in the proper orientation with the porous plate 5 separating the two, and the assembly plates 2 and 9 abandoned. In FIG. 4, cutaway studs 27 are shown which would mate with the openings in the top assembly plate 2 and fasten the members into a fluid tight assembly.

The mercury pool which comprises the cathode of the electrolysis cell of this invention is not shown but would be present in the second chamber and in operation would completely cover the cooling tubes-electrode 16 shown in section 7. A predetermined volume of mercury can be introduced into the second chamber, after the assembly has been made tight, through the inlet ports 13 of section 6.

In operation, an anolyte solution is circulated continuously into and out of the first chamber. A typical anolyte solution is comprised of an aqueous solution of sodium carbonate in a concentration that will provide the least resistance to the current flowing in the cell. Those skilled in the art of electrochemical reactions will know that the balance of an electrolysis cell requires a consideration of the concentration of the catholyte as well as the anolyte. In any event, electrons leave the electrolysis cell at the anode and in consequence of the acid formed in the anolyte, which is neutralized by the sodium carbonate present, additional amounts of solute may be required in the anolyte as the electrolysis procedes to maintain a uniform concentration of the solute therein.

A cooling medium is circulated continuously through the cooling tubes 11. Any suitable coolant is satisfactory and when such cooling system is maintained independently of the cooling system to which the catholyte is exposed, water can be used effectively, or, when water is of low dielectric constant it can be circulated through both anode and cathode.

Concurrently with the circulation of an anolyte through the first chamber, a catholyte comprised of an electroactive solute in an appropriate solvent is circulated continuously into and out of the second chamber of the cell. Those skilled in the art will recognize the requirement for using an anolyte solution that is compatible with the catholyte solution and a molecular concentration of the catholyte solute balanced with such concentration of the anolyte solute.

The rate of the electrolysis is managed by controlling the direct current that is applied to the cell. A constant resistance is maintained by carefully controlling the concentrations of the anolyte and catholyte solutes. Consequently, the quantity of current flowing through the cell is controlled by regulating the voltage applied thereto to maintain a constant ampere consumption. As various electroactive solutes will have differing sensitivity to the electrical energy applied thereto, those skilled in the art will recognize the need to tailor the current consumption of the cell to the electro-stability of the solute.

Not all of the electroactive solute will be electrolyzed in a single pass through the electrolysis cell, so serial passages may be provided or a continuous circulation of the catholyte through the second chamber is carried out until the electrolysis is complete.

A significant benefit achieved by the continuous flow-through mercury cathode electrolysis cell of this invention is the high efficiency of the mercury cathode-catholyte contact. In the design of the catholyte chamber cathode areas of 1.4 $cm^2$/1CC volume and up can be achieved, parallel flow of the anolyte and catholyte solutions assures the highest current effectiveness through contributing to a constant potential or current density under any given consistent operating conditions, and a high turbulence is imparted to the catholyte solution in the second chamber through the construction of the inlet and outlet thereto which results in the maximum contact between the mercury pool cathode and the solute in the catholyte.

What is claimed is:

1. A continuous flow-through mercury cathode electrolysis cell comprising:

a. a first chamber comprising a wide shallow cavity closed on the top and open on the bottom, said chamber having an inlet port or ports thereto and oppositely disposed outlet port or ports and an electrode disposed therein;

b. a non-conductive porous plate adapted to be the bottom of said first chamber and the top of a second chamber;

c. a second chamber comprising a wide shallow cavity closed on the bottom and open on the top, said chamber having one or more inlet ports opening thereinto near the top thereof at an acute angle to the side thereof and an outlet port therefrom comprising a standpipe extending upwardly from the bottom of said cavity to a point near the top and substantially in the center thereof;

d. means for axially disposing said first and second chambers in a vertical orientation in a fluid tight assembly, the first above the second with said porous plate separating the two chambers;

e. a first and second electrode disposed respectively in said first and said second chambers; and f. a mercury pool disposed in the bottom of said second chamber, said mercury pool completely covering said electrode.

2. A cathode chamber of a continuous flow-through mercury cathode electrolysis cell comprising;

a. a wide shallow cavity having a top and a bottom, the top of which is comprised of a non-conductive porous plate, and having inlet ports thereto which open thereinto on the sides thereof at an acute angle to the wall thereof and an outlet port comprising a standpipe extending upwardly from the bottom of said cavity substantially in the center thereof to a point just below the top thereof;

b. an electrode disposed in said chamber; and c. a mercury pool disposed in the bottom of said chamber said mercury pool completely covering said electrode.

3. A cathode chamber of a continuous flow-through mercury cathode electrolysis cell comprising:

a. a wide shallow cavity having a top and a bottom, the top of which is comprised of a non-conductive porous plate, and having inlet ports thereto which open thereinto on the side thereof at an acute angle to the wall thereof and an outlet port comprising a standpipe extending upwardly from the bottom of said cavity substantially in the center thereof to a point just below the top thereof;

b. an electrode disposed in said chamber;

c. a mercury pool disposed in the bottom of said chamber said mercury pool completely covering said electrode; and d. heat exchanging means immersed in said mercury pool.

4. The cathode chamber of claim 3 wherein said electrode and said heat exchanging means are a common element comprising a conductive tube or tubes through which a coolant is circulated.

5. A continuous flow-through mercury cathode electrolysis cell comprising;

a. a first chamber comprising a wide shallow cavity closed on the top and open on the bottom, said chamber having an inlet port or ports thereto and oppositely disposed outlet port or ports therefrom, and heat exchanging means disposed therein;

b. a non-conductive porous plate adapted to be the bottom of said first chamber and the top of a second chamber;

c. a second chamber comprising a wide shallow cavity closed on the bottom and open on the top, said chamber having one or more ports opening thereinto near the top thereof at an acute angle to the side thereof and an outlet port therefrom comprising a standpipe extending upwardly from the bottom of said cavity to a point near the top and substantially in the center thereof, and heat exchanging means disposed therein;

d. means for axially disposing said first and second chambers in a vertical orientation in a fluid tight assembly, the first above the second with said porous plate separating the two chambers;

e. a first and a second electrode disposed respectively in said first and said second chambers; and f. a mercury pool disposed in the bottom of said second chamber, said mercury pool completely covering said electrode.

6. The electrolysis cell of claim 5 wherein each of the said electrodes and heat exchanging means disposed in each chamber is a common element comprising a conductive tube or tubes through which a coolant is circulated.

* * * * *